US011187452B2

(12) United States Patent
El Sayed et al.

(10) Patent No.: US 11,187,452 B2
(45) Date of Patent: Nov. 30, 2021

(54) REFRIGERATOR WITH ADJUSTABLE BIN SYSTEM

(71) Applicant: WHIRLPOOL CORPORATION, Benton Harbor, MI (US)

(72) Inventors: Kamil El Sayed, Wroclaw (PL); Marek Gorzelanczyk, Kobyla Gora (PL); Wojciech Klupa, Wroclaw (PL)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/828,058

(22) Filed: Mar. 24, 2020

(65) Prior Publication Data

US 2021/0302093 A1 Sep. 30, 2021

(51) Int. Cl.

| | |
|---|---|
| ***F25D 23/04*** | (2006.01) |
| ***F25D 23/02*** | (2006.01) |
| ***F25D 23/06*** | (2006.01) |

(52) U.S. Cl.

CPC ..... *F25D 23/04* (2013.01); *F25D 23/028* (2013.01); *F25D 23/067* (2013.01); *F25D 2201/12* (2013.01); *F25D 2325/021* (2013.01)

(58) Field of Classification Search

CPC ..... F25D 23/028; F25D 23/04; F25D 23/067; F25D 25/02; F25D 25/022; F25D 25/024; F25D 2201/12; F25D 2323/02; F25D 2323/06; F25D 2325/00; F25D 2325/021

See application file for complete search history.

(56) References Cited

U.S. PATENT DOCUMENTS

| | | | | |
|---|---|---|---|---|
| 2,705,565 A | | 7/1952 | Mckirgan | |
| 3,404,596 A | * | 10/1968 | Ryder | F16B 13/14 411/36 |
| 3,469,493 A | * | 9/1969 | Fisher | F16B 9/02 411/71 |
| 6,460,956 B1 | * | 10/2002 | Disbennett | F25D 23/067 312/406 |
| 6,582,038 B2 | | 6/2003 | Moreno-Olguin et al. | |
| 6,729,705 B2 | * | 5/2004 | Wolanin | F25D 23/067 312/408 |

(Continued)

FOREIGN PATENT DOCUMENTS

| | | | | |
|---|---|---|---|---|
| CN | 101025325 A | * | 8/2007 | F25D 23/04 |
| CN | 203771882 U | * | 8/2014 | F25D 23/04 |

(Continued)

*Primary Examiner* — Andrew M Roersma

(74) *Attorney, Agent, or Firm* — Price Heneveld LLP

(57) ABSTRACT

A refrigerator includes a housing defining an interior compartment with an open side and a door rotatably coupled with the housing and selectively closing at least a portion of the open side. The door includes a door liner having a plurality of mounting members mounted thereto. The mounting members are foamed-in place by an interconnection with an insulation material provided in an inner cavity of the door. The mounting members further include mounting plates extending outwardly from an outer surface of the door liner. The refrigerator further includes a storage compartment system comprised of multiple interconnecting modules that are removeably mounted to the mounting plates of the mounting members. The interconnecting modules can be reconfigured to provide multiple arrangements of storage compartments supported on the door.

17 Claims, 16 Drawing Sheets

(56) References Cited

U.S. PATENT DOCUMENTS

| | | | | |
|---|---|---|---|---|
| 7,300,120 | B2 | 11/2007 | Shin | |
| 7,703,865 | B2 | 4/2010 | Knoller | |
| 9,389,012 | B2 | 7/2016 | Rackley et al. | |
| 9,400,132 | B2 | 7/2016 | Shrader et al. | |
| 9,435,579 | B1 * | 9/2016 | House | F25D 23/028 |
| 9,702,614 | B2 * | 7/2017 | Lim | F25D 23/025 |
| 9,784,494 | B2 | 10/2017 | Chow et al. | |
| 2006/0244350 | A1 * | 11/2006 | Martin | F25D 25/021 312/404 |
| 2006/0279188 | A1 * | 12/2006 | Alitalo | F25D 23/04 312/401 |
| 2018/0216874 | A1 | 8/2018 | Pinheiro et al. | |

FOREIGN PATENT DOCUMENTS

| | | | | | |
|---|---|---|---|---|---|
| DE | 19633973 | A1 * | 2/1998 | | F25D 23/04 |
| EP | 0675332 | A2 | 10/1995 | | |
| JP | H-04165281 | A * | 6/1992 | | F25D 23/04 |
| KR | 1020040104009 | A * | 12/2004 | | F25D 23/04 |
| KR | 1020130061522 | A * | 6/2013 | | F25D 23/04 |
| WO | WO-2018172087 | A1 * | 9/2018 | | F25D 23/04 |

* cited by examiner

REFRIGERATOR WITH ADJUSTABLE BIN SYSTEM

BACKGROUND OF THE DISCLOSURE

The present device generally relates to a reconfigurable storage arrangement for a refrigerator, and more specifically, to a refrigerator with a reconfigurable bin system that is configured for arrangement on an interior of a refrigerator door.

Most types and configurations of refrigerators provide for some type of storage of items along an interior portion or surface of the refrigerator door or doors used to enclose one or both of the fresh food and freezer compartments provided therein. In connection with larger refrigerators, bins can be fully removed or removeably coupled to the interior of the door by way of interengaging features of the door and the bins. Such arrangements require that the bins either be coupled to the door, or removed therefrom. Accordingly, only limited adjustability or reconfiguration of the storage provided along the door is provided. In this manner, further advancements may be desired.

SUMMARY OF THE DISCLOSURE

According to one aspect of the present disclosure, a refrigerator includes a housing defining an interior compartment with an open side. A door is rotatably coupled to the housing and selectively closes at least a portion of the open side. The door includes a door liner having an outer surface. At least one mounting member is coupled to the door liner and includes a mounting plate extending outwardly from the outer surface of the door liner. A first storage compartment includes at least one module. The one module includes a rear wall and an engagement member extending outwardly from the rear wall. The engagement member includes a downwardly opening receiving channel. The mounting plate of the mounting member is received in the downwardly opening receiving channel of the engagement member to removeably mount the first storage compartment to the door liner of the door.

According to another aspect of the present disclosure, a storage compartment system includes a first end module having a body portion with inner and outer surfaces spaced-apart from one another to define a hollow interior cavity therebetween. The body portion of the first end module defines a storage space inwardly opening in a first direction. A second end module includes a body portion with inner and outer surfaces spaced-apart from one another to define a hollow interior cavity therebetween. The body portion of the second end module defines a storage space inwardly opening in a second direction that is opposed to the first direction. An intermediate module includes a body portion with a U-shaped configuration to define an upwardly opening storage space. The body portion of the intermediate module includes first and second ends. The first end of the body portion of the intermediate module is received in the hollow interior cavity of the first end module. The second end of the body portion of the intermediate module is received in the hollow interior cavity of the second end module.

According to yet another aspect of the present disclosure, a refrigerator includes a door having a door liner. The door liner includes a plurality of mounting apertures disposed therethrough and opening into an inner cavity of the door. A plurality of mounting members is provided, wherein each mounting member of the plurality of mounting members includes a base portion having a hollow interior portion.

Each base portion of each mounting member is received through one of the mounting apertures of the plurality of mounting apertures of the door liner and is at least partially received within the inner cavity of the door. An insulation material is disposed within the inner cavity of the door and at least partially fills each hollow interior portion of each base portion of the plurality of mounting members.

These and other features, advantages, and objects of the present disclosure will be further understood and appreciated by those skilled in the art by reference to the following specification, claims, and appended drawings.

DETAILED DESCRIPTION

Figure 1:
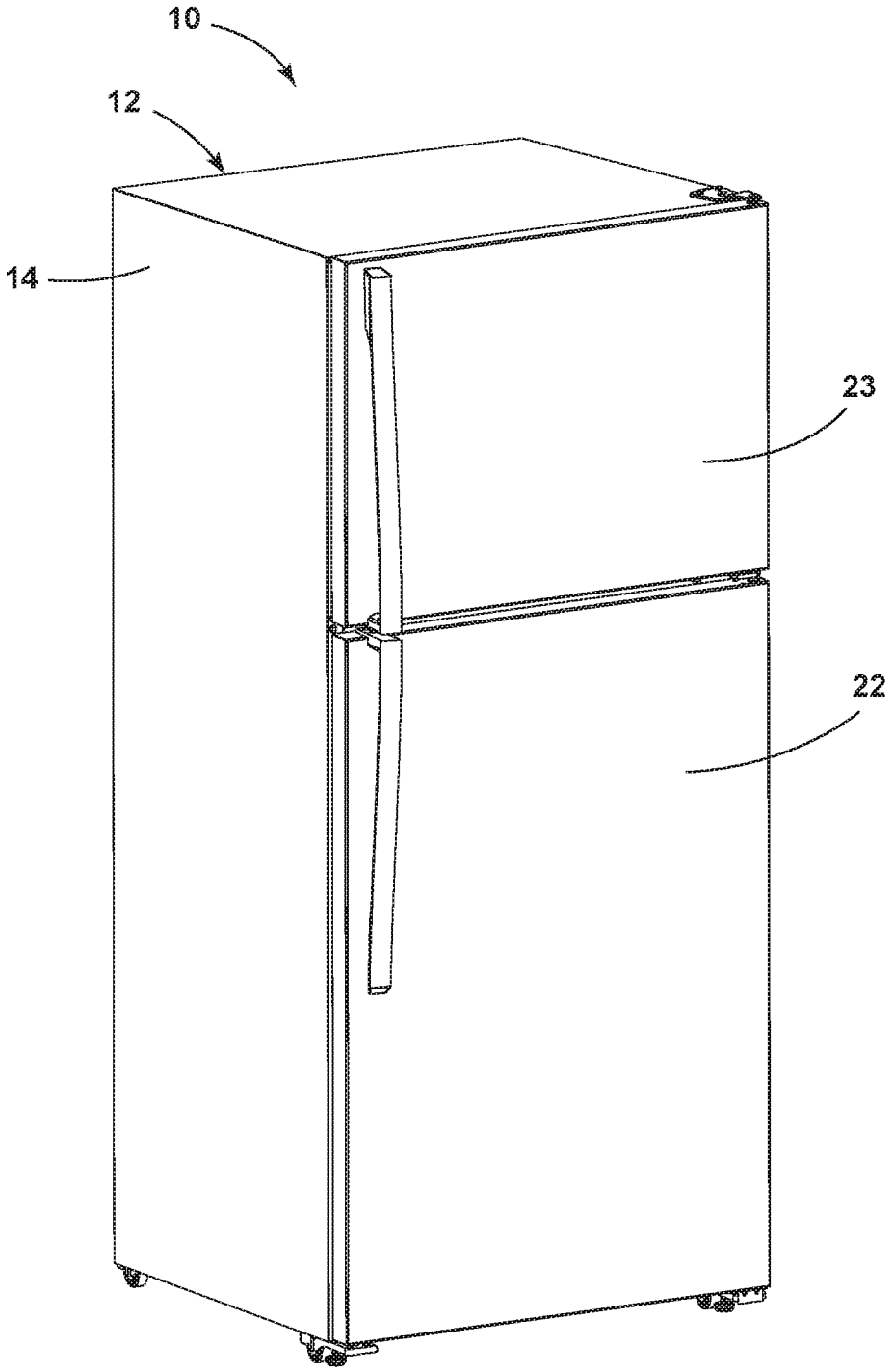
FIG. 1 is a front perspective view of a refrigerator showing a refrigerator door in a closed position.

The present illustrated embodiments reside primarily in combinations of method steps and apparatus components related to a storage compartment system for a refrigerator. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 2:
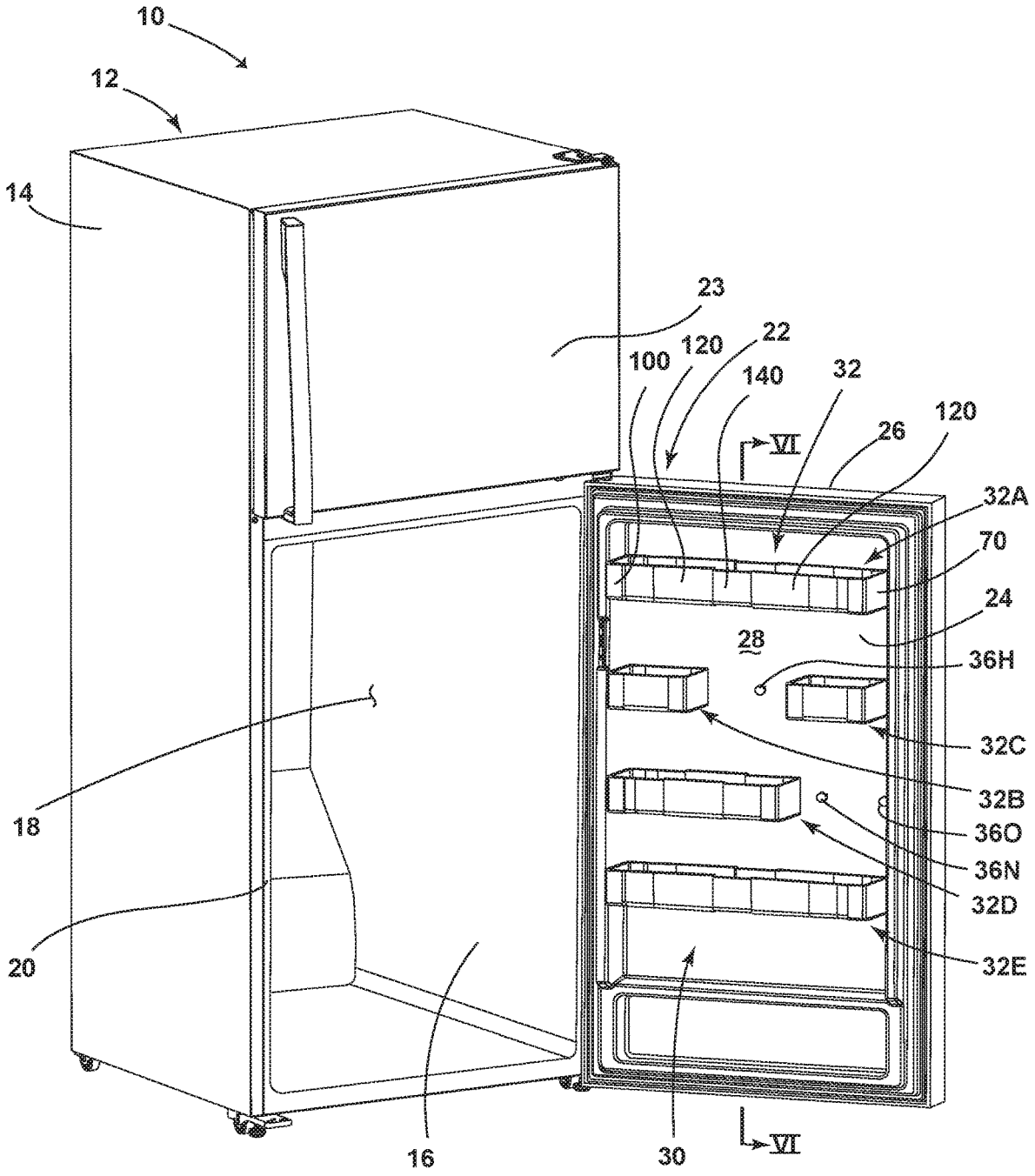
FIG. 2 is a front perspective view of the refrigerator of FIG. 1 showing the refrigerator door in an open position to reveal a storage compartment system according to the present disclosure configured in a first configuration.

Referring now to FIGS. 1 and 2, the reference numeral 10 generally designates a refrigerator having a housing 12 that in the present example includes an outer wrapper 14 and an interior liner 16 with an insulating material filling a void positioned between the wrapper 14 and the liner 16. The housing 12 defines an interior compartment 18 bounded on five sides by the interior liner 16 with an open side 20 allowing for access to the interior compartment 18. A door 22 is rotatably coupled with the housing 12 and selectively closes at least a portion of the open side 20 of the interior compartment 18. The door 22 includes a door liner 24 within a door wrapper 26 that, similar to housing 12, encloses insulation within a void between the door liner 24 and the door wrapper 26.

The refrigerator 10 shown in FIGS. 1 and 2 further includes a door 23 that is configured to selectively provide access to a freezer compartment. The interior compartment 18 shown in FIGS. 1 and 2 is contemplated to be a refrigerated compartment for storing fresh food items. As such, the door 22 is contemplated to be a refrigerator door. With specific reference to FIG. 2, the refrigerator 10 includes a storage compartment system 30 of the present concept disposed on the door 22. It is contemplated that the storage compartment system 30 may be provided on the door 23 as well for use with a freezer compartment. Further, it is consummated that the storage compartment system 30 of the present concept may be provided in any configuration of a refrigerator or freezer, such as a French door style refrigerator, top and bottom mount refrigerators, single door and side-by-side refrigerators, wine coolers and other like refrigerated appliances, without departing from the spirit of the present concept.

With further reference to FIG. 2, the storage compartment system 30 is shown having a plurality of storage compartments 32 made up of storage compartments 32A-32E arranged in a first configuration on an outer surface 28 of the door liner 24. The storage compartments 32A-32E of the storage compartment system 30 are shown in the form of open storage compartments, but may include other types of storage compartments, such as bins with doors, open shelves, and other like storage compartments. The storage compartments 32A-32E of the storage compartment system 30 are comprised of individual storage compartment modules that are removeably mounted to the outer surface 28 of the door liner 24 in a manner as further described below. Thus, the storage compartment system 30 of the present concept is adapted to provide customized configurations with increased adaptability compared to known storage compartment systems. In FIG. 2, three different sizes of storage compartments are shown, however, multiple different size storage compartments can be provided in other configurations.

Figure 3:
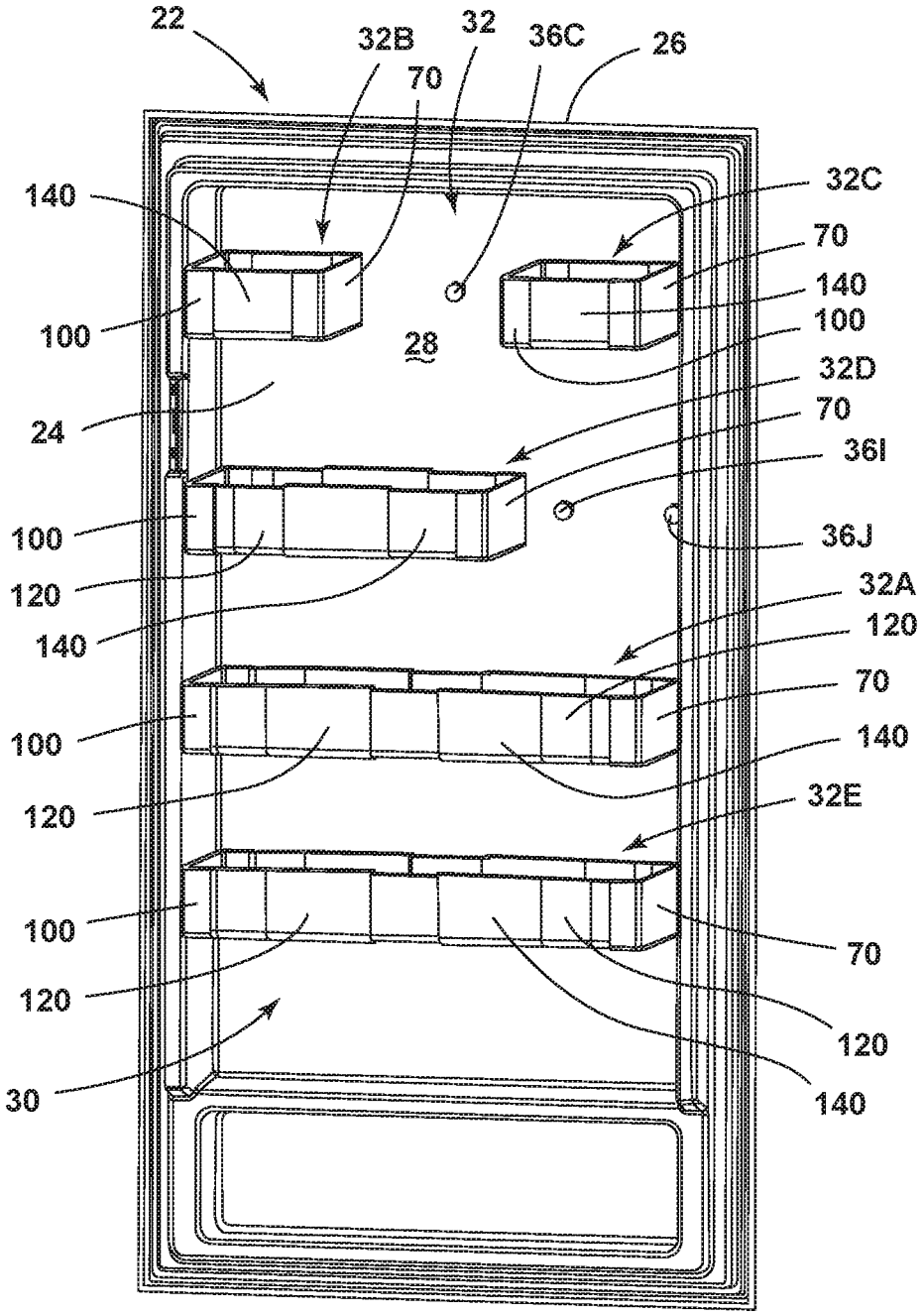
FIG. 3 is a top perspective view of the door of FIG. 2 showing the storage compartment system configured in a second configuration.

As noted above, the storage compartment system 30 may be provided in multiple configurations. Referring now to FIG. 3, the storage compartment system 30 includes storage compartments 32A-32E configured in a second configuration on the door 22 that is different than the first configuration shown in FIG. 2. It is contemplated that more or fewer storage compartments may be included in any configuration of the plurality of storage compartments 32 of the storage compartment system 30. In FIG. 3, the individual components or modules of the storage compartments 32A-32E are identified as end modules 70 and 100, adapter modules 120 and intermediate modules 140, all further described below.

Figure 4A:
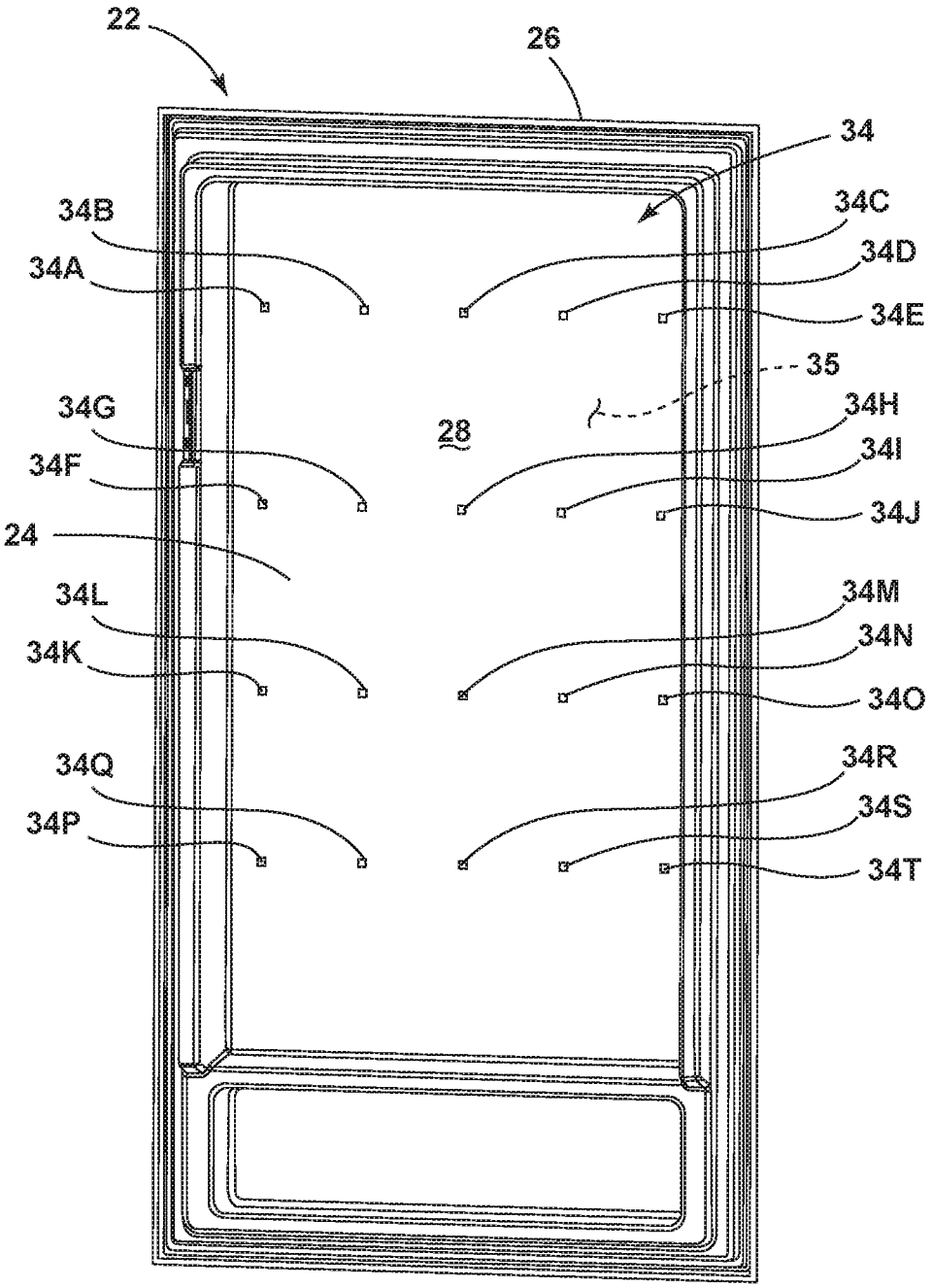
FIG. 4A is a top perspective view of the door of FIG. 3 with the storage compartment system removed.

Referring now to FIG. 4A, the door 22 includes a plurality of mounting apertures 34 disposed through the door liner 24. In the embodiment shown in FIG. 4A, the plurality of mounting apertures 34 includes mounting apertures 34A-34T positioned in four rows of mounting apertures 34A-34E, 34F-34J, 34K-34O, and 34P-34T. It is contemplated that more or less rows of mounting apertures may be provided having greater or fewer mounting apertures per row. The mounting apertures 34A-34T shown in FIG. 4A are square-shaped mounting apertures, but it is contemplated that any shape for the mounting apertures 34A-34T may be used with the present concept. The mounting apertures 34A-34T are contemplated to open into an inner cavity 35 of the door 22 that is positioned between the door liner 24 and the door wrapper 26. The inner cavity 35 of the door 22 may be described as an insulation cavity and may include a vacuum pressurized cavity.

Figure 4B:
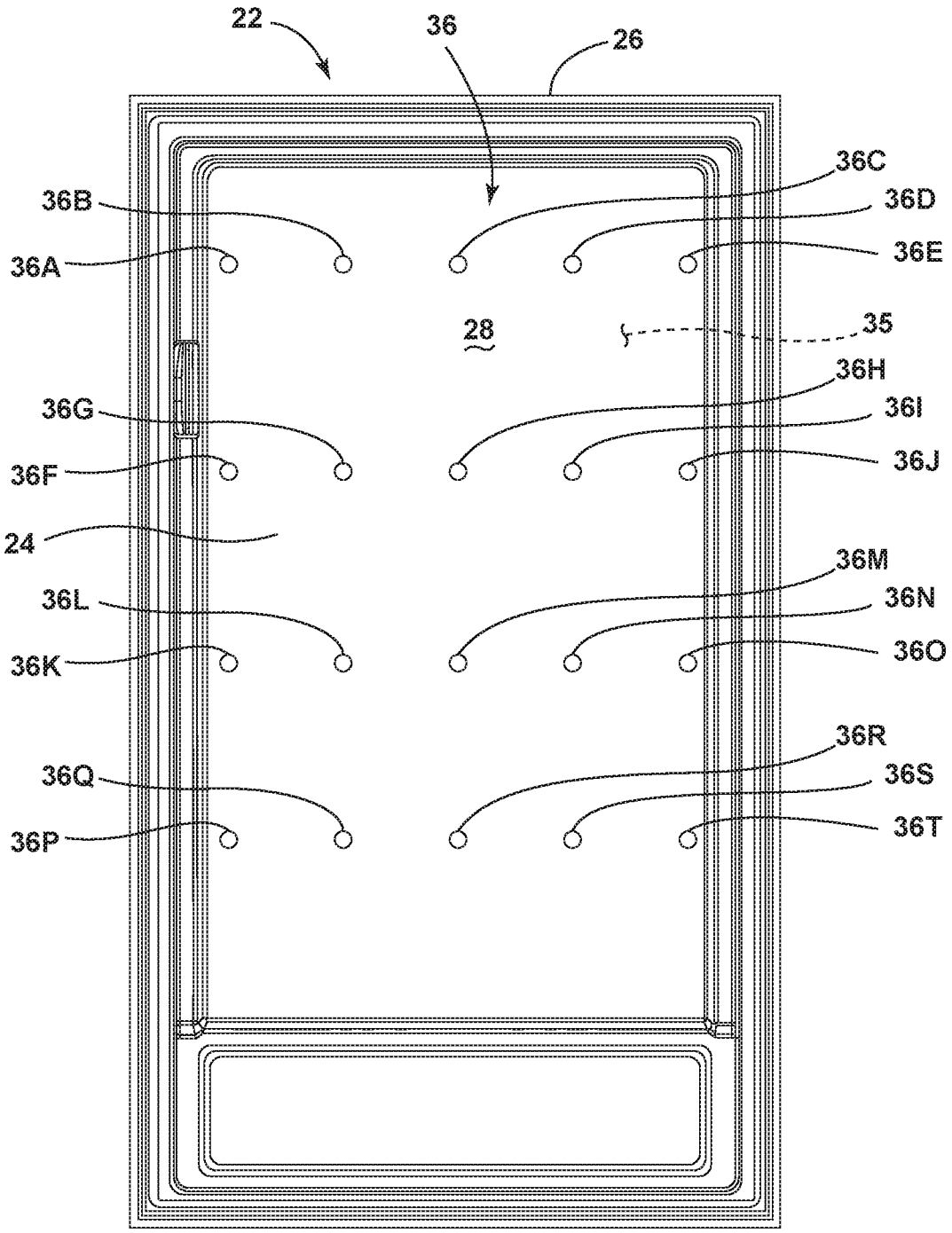
FIG. 4B is a top perspective view of the door of FIG. 4A with the mounting members coupled to the door.

Referring now to FIG. 4B, the door 22 includes a plurality of mounting members 36 coupled to the door liner 24 at the plurality of mounting apertures 34 (FIG. 4A). In the embodiment shown in FIG. 4B, the plurality of mounting members 36 includes mounting members 36A-36T received in the mounting apertures 34A-34T (FIG. 4A), respectively. as received in the mounting apertures 34A-34T (FIG. 4A), the mounting members 36A-36T are positioned in four rows of mounting members 36A-36E, 36F-36J, 36K-36O, and 36P-36T. As noted above, the mounting apertures 34A-34T shown in FIG. 4A are square-shaped apertures that provide an anti-rotational effect to the mounting members 36A-36T, as further described below. With storage compartments mounted on select mounting members of the plurality of mounting members 36, unused mounting members may be visible and available in any one configuration of storage compartments. For instance in the first configuration of storage compartments shown in FIG. 2, mounting members 36H, 36O and 36N are unused or available mounting members that are not needed to support the storage compartments 32A-32E in the first configuration. In the second configuration of storage compartments shown in FIG. 3, mounting members 36C, 36I and 36J are unused or available mounting members that are not needed to support the storage compartments 32A-32E in the second configuration.

Figure 5A:
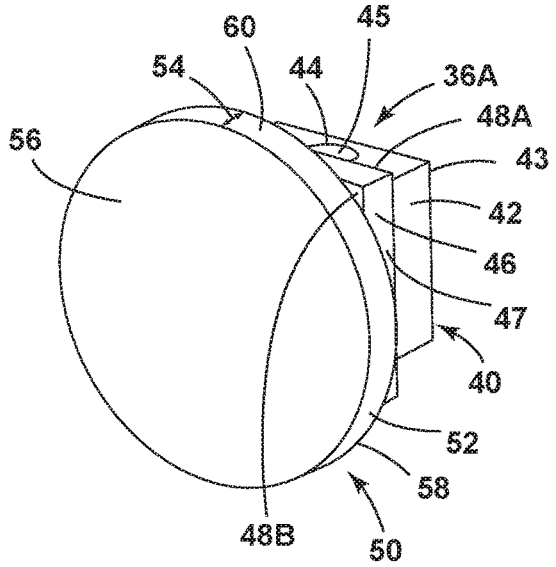
FIG. 5A is a top front perspective view of a mounting member.
Figure 7:
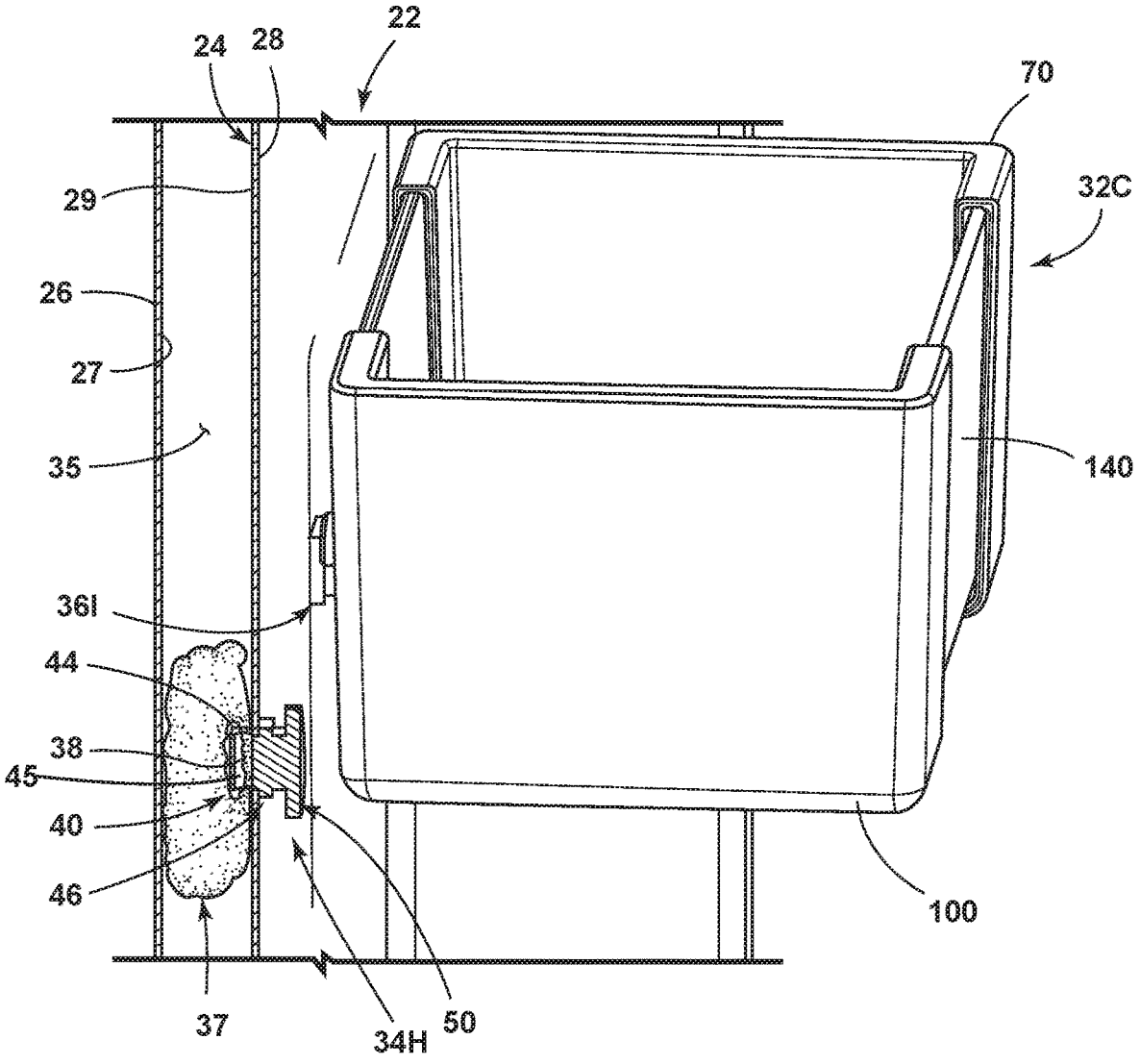
FIG. 7 is a top front perspective cross-sectional view of the door of FIG. 2 taken at line VI.

Referring now to FIGS. 5A-5E, the mounting member 36A is shown from multiple views and is an exemplary illustration of the other mounting members 36B-36T, to which the following description also applies. The mounting member 36A includes a base portion 40 having a body portion 42 with an aperture 44 disposed therethrough. The aperture 44 opens into a hollow interior portion 45 of the base portion 40 at upper and lower sides of the base portion 40. In the embodiment of FIG. 5A, the hollow interior portion 45 is shown as a vertically disposed round channel, but may include a horizontally disposed channel, or may include more than one channel disposed through the body portion 42 of the base portion 40. It is further contemplated that the hollow interior portion 45 may extend into the body portion 42 of the base portion 40 without fully extending through, such that the hollow interior portion 45 of the base portion may be contained within the body portion 42 of the base portion 40. The hollow interior portion 45 is configured to receive an amount of a foaming agent (or other like insulation material) within the inner cavity 35 of the door 22, as best shown in FIG. 7. In this way, the mounting members 36 of the present concept are foamed-in-place and rigidly retained on the door liner 24. The hollow interior portion 45 may include any configuration within the base portion 40 and is not limited to the vertical round channel shown in FIGS. 5A-5E.

Figure 5B:
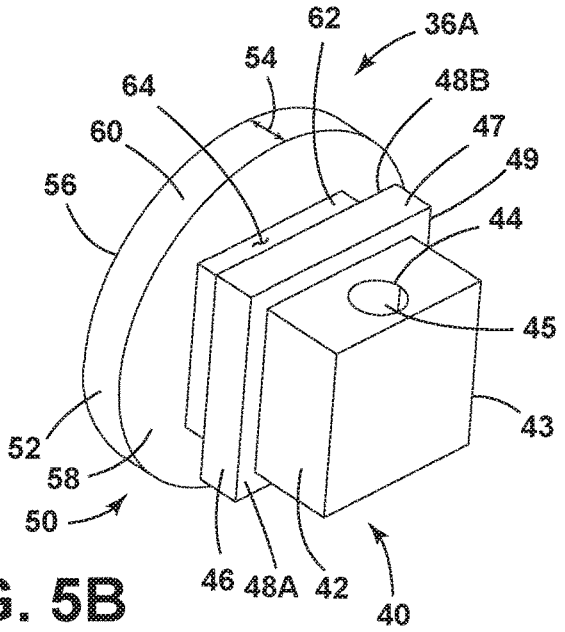
FIG. 5B is a top rear perspective view of the mounting member of FIG. 5A.
Figure 5C:
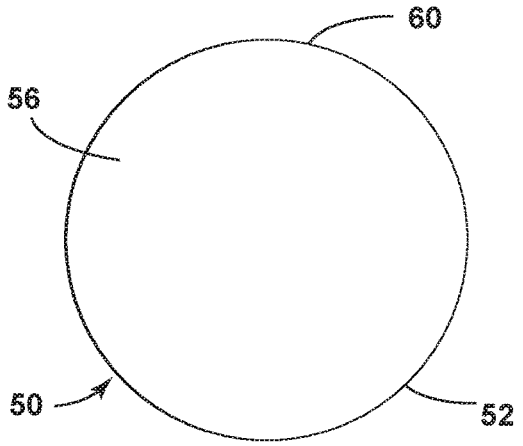
FIG. 5C is a front elevational view of the mounting member of FIG. 5A.

As best illustrated in FIG. 5B, the body portion 42 of the base portion 40 has a substantially square-shaped configuration for being closely received within one of the square-shaped mounting apertures 34A-34T of the door liner 24. The body portion 42 of the base portion 40 may include other geometric configurations, but is generally configured to be received within one of the mounting apertures 34A-34T. Therefore, the body portion 42 of the base portion 40 is generally provided with a geometric configuration that correlates to a geometric configuration of the mounting apertures 34A-34T. As correlated to one another, the body portion 42 of the base portion 40 of the mounting member 36A includes an outer perimeter 43 that is slightly smaller than the mounting apertures 34A-34T, such that the body portion 42 of the base portion 40 of the mounting member 36A is sized for fitted reception within the same, as best shown in FIG. 6.

Figure 5D:
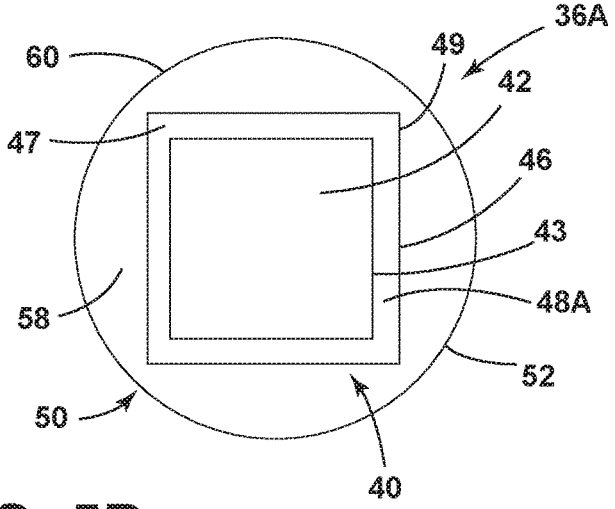
FIG. 5D is a rear elevational view of the mounting member of FIG. 5A.
Figure 5E:
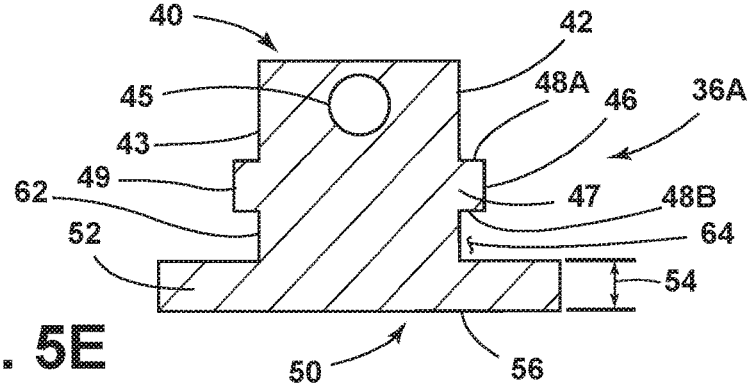
FIG. 5E is a cross-sectional view of the mounting member of FIG. 5A.

As further shown in FIGS. 5A, 5B and 5D, the mounting member 36A further includes an abutment plate 46 disposed adjacent to the base portion 40. The abutment plate 46 includes a rear surface 48A that is configured to abut the outer surface 28 of the door liner 24, as best shown in FIG. 6. As such, the abutment plate 46 includes a body portion 47 with an outer perimeter 49 that is larger than the outer perimeter 43 of the body portion 42 of the base portion 40, such that abutment plate 46 abuts the outer surface 28 of the door liner 24, and is not received through a corresponding mounting aperture in assembly. The abutment plate 46 further includes a front surface 48B from which a stem 62 outwardly extends. A mounting plate 50 is disposed on the stem 62. Thus, the stem 62 spaces the mounting plate 50 away from the abutment plate 46 to define a channel 64 positioned between the abutment plate 46 and the mounting plate 50. As shown in FIGS. 5A-5E, the mounting plate 50 includes a body portion 52 with a width identified by arrow 54. The width of the mounting plate 50 is defined between outer and inner surfaces 56, 58 of the mounting plate 50. Thus, the channel 64 provided between the mounting plate 50 and the abutment plate 46 is specifically provided between the front surface 48B of the abutment plate 46 and the inner surface 58 of the mounting plate 50. In FIGS. 5A-5E, the mounting plate 50 is shown in the form of a disc-shaped or circular plate having a curved upper portion 60. Specifically, the curved upper portion 60 is a downwardly curved upper portion in the embodiment of FIGS. 5A-5E. In use, the mounting member 36A is provided to interconnect or otherwise mount individual modules of the storage compartment system 30 (FIG. 2) to the door 22, as further described below.

Figure 6:
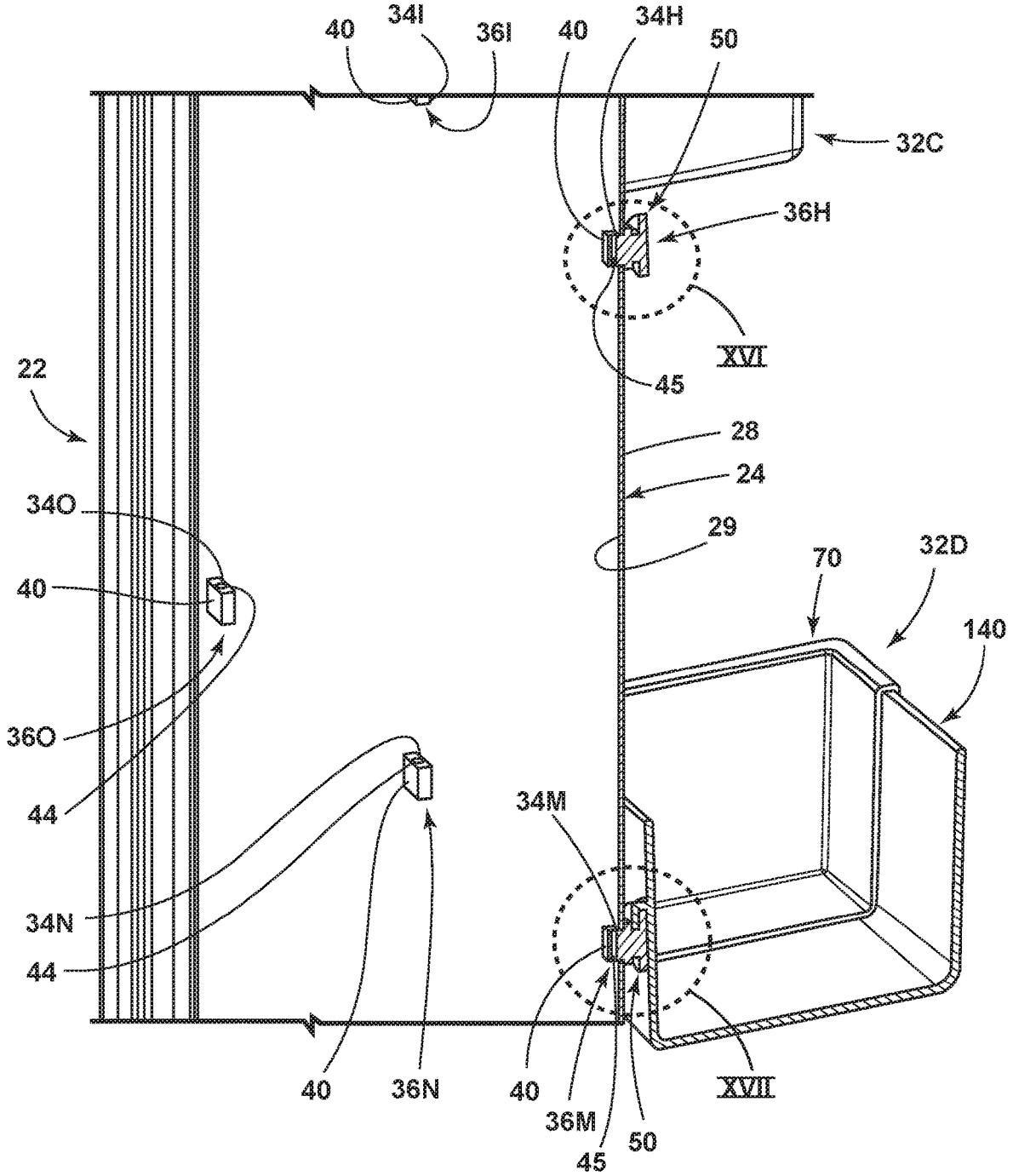
FIG. 6 is a top rear perspective cross-sectional view of the door of FIG. 2 taken at line VI.

Referring now to FIG. 6, the base portions 40 of mounting members 36I, 36H, 36O, 36N and 36M are shown extending through their respective mounting apertures 34I, 34H, 34O, 34N and 34M disposed through the door liner 24. In this way, the base portions 40 are disposed on an opposite side of the door liner 24 as compared to the mounting plates 50 specifically shown with reference to mounting members 36H and 36M. It is contemplated that the base portions 40 are disposed within the inner cavity 35 of the door 22. As illustrated with particular reference to the base portions 40 of mounting members 36O and 36N, apertures 44 are also shown disposed within the inner cavity 35 of the door 22. In this way, the apertures 44, which open into the hollow interior portions 45 of the base portions 40 as described above, can be filled with an insulation material, such as a foaming agent. As a foaming agent hardens, the mounting members 36 will be securely mounted to the door liner 24 with the base portions 40 thereof fully engaged with the foam insulation material 37 (FIG. 7) via the hollow interior portions 45. In the cross-sectional view of FIG. 6, the hollow interior portions 45 of mounting members 36H and 36M are revealed within the respective base portions 40.

Referring now to FIG. 7, mounting member 36H is shown as an available mounting member positioned next to storage compartment 32C which is at least partially supported by mounting member 36I. Mounting member 36H is shown having a base portion 40 disposed within the inner cavity 35 of the door 22 which is positioned between an inner surface 27 of the door wrapper 26 and an inner surface 29 of the door liner 24. In the embodiment shown in FIG. 7, the inner cavity 35 includes an insulation material 37 contemplated to be a foam insulation material that can be sprayed into the inner cavity 35 of the door 22 between the door liner 24 and the door wrapper 26. The inner cavity is contemplated to be substantially filled with an insulation material that would also fill the hollow interior portion 45 of mounting member 36H to retain mounting member 36H in place on the door liner 24. In FIG. 7, the inner cavity 35 of the door 22 is only partially filled with the insulation material 37 for clarity purposes. As further shown in FIG. 7, the insulation material 37 includes a portion 38 of the insulation material 37 that is disposed within the hollow interior portion 45 of mounting member 36H. The portion 38 of the insulation material 37 may at least partially fill the hollow interior portion 45 of the mounting members 36, or may completely fill the hollow interior portions 45 thereof. Thus, when the insulation material 37, 38 is in the form of a foam insulation material, the insulation material 37 will cure and harden to provide a solid interconnection between the hollow interior portion 45 of mounting member 36H, the door liner 24 and the door wrapper 26. This interconnection between the insulation material 37 and the mounting member 36H is contemplated to be provided between all mounting members 36A-36T and the insulation material 37 within the inner cavity 35 of the door 22.

Figure 8A:
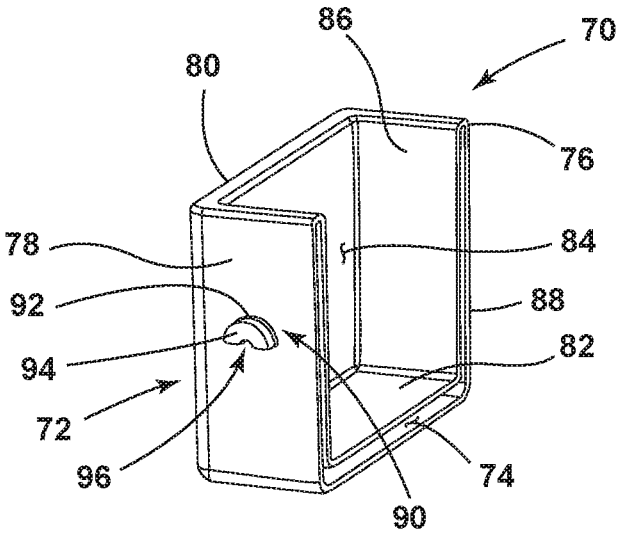
FIG. 8A is a top rear perspective view of a storage compartment end module.
Figure 8B:
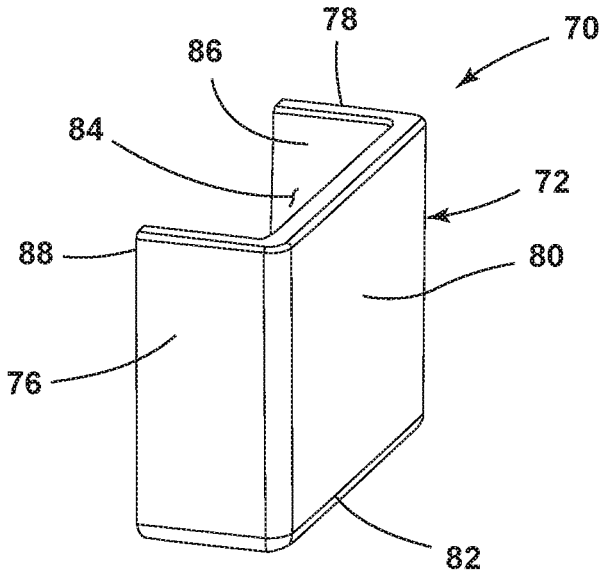
FIG. 8B is a top front perspective view of the storage compartment end module of FIG. 8A.

Referring now to FIGS. 8A and 8B, a storage compartment end module 70 is shown. The end module 70 is a right-hand end module which includes a body portion 72 having a hollow interior cavity 74. The body portion 72 includes a front wall 76, a rear wall 78, an interconnecting sidewall 80 and a bottom wall 82. The front and rear walls 76, 78 are spaced-apart from one another and interconnected by the sidewall 80 and the bottom wall 82. Together, the front wall 76, rear wall 78, sidewall 80 and bottom wall 82 cooperate to define an inwardly opening storage space 84. Specifically, the storage space 84 of the right-hand end module 70 opens inwardly in a first direction towards the left when mounted to the door 22, as shown in FIG. 2. The body portion 72 of the end module 70 further includes an inner surface 86 and an outer surface 88 that are spaced-apart from one another to define and surround the hollow interior cavity 74. The interior cavity 74 generally runs along the front wall 76 bottom wall 82 and rear wall 78 to define a generally U-shaped interior cavity. In use, the interior cavity 74 of the end module 70 is configured to receive an end portion of an intermediate module, as further described below. The sidewall 80 defines a closed end of the end module 70, while the hollow interior cavity 74 is disposed at an open end of the end module 70.

With specific reference to FIG. 8A, the end module 70 includes an engagement member 90 disposed on the rear wall 78. The engagement member 90 includes a first portion 92 that outwardly extends from the rear wall 78 of the end module 70. The engagement member 90 further includes a second portion 94 that downwardly extends from the end of the first portion 92. Together the first and second portions 92, 94 of the engagement member 90 and the rear wall 78 of the end module 70 cooperate to define a downwardly opening receiving channel 96. The downwardly opening receiving channel 96 of the end module 70 is configured to receive a mounting plate of a mounting member, such as mounting plate 50 described above with reference to mounting member 36A, to removeably mount the end module 70 to the door 22. Specifically, the downwardly opening receiving channel 96 is a downwardly curved receiving channel configured to closely receive the curved upper portion 60 of a corresponding mounting plate 50. In the first configuration of the storage compartment system 30 shown in FIG. 2, it is contemplated that the end module 70 shown in FIG. 8A would be mounted to mounting member 36E (FIG. 4B).

Figure 9A:
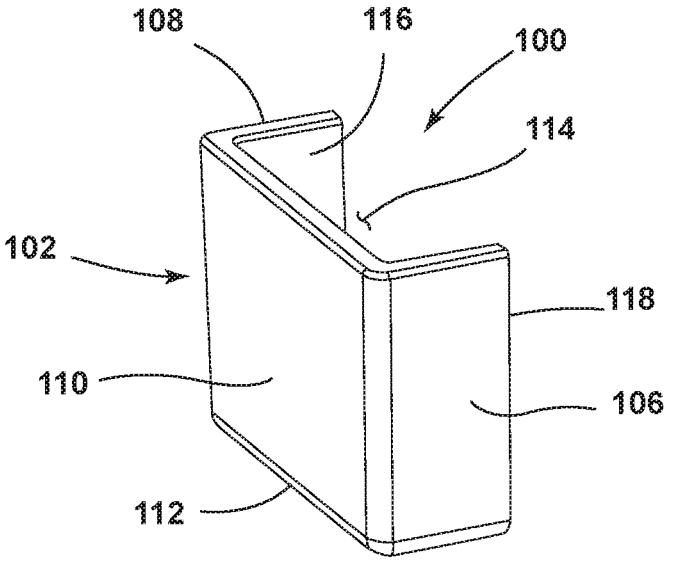
FIG. 9A is a top front perspective view of a storage compartment end module.
Figure 9B:
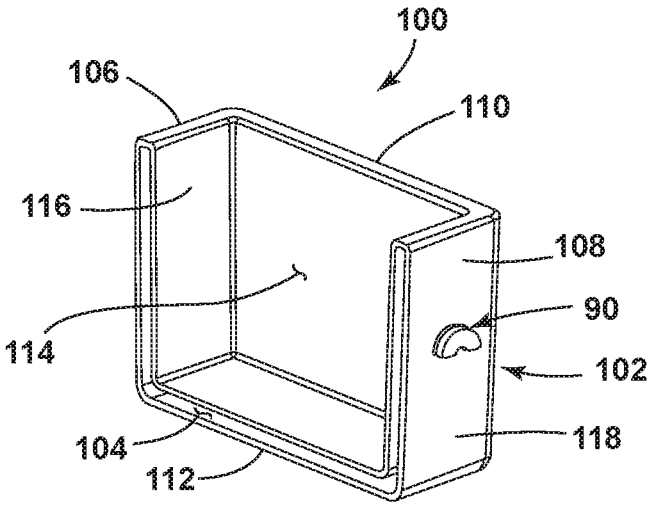
FIG. 9B is a top rear perspective view of the storage compartment end module of FIG. 9A.

Referring now to FIGS. 9A and 9B, a storage compartment end module 100 is shown. The end module 100 is a left-hand end module that is provided in a mirrored configuration to the right-hand end module 70 described above with reference to FIGS. 8A and 8B. Like the end module 70, the end module 100 includes a body portion 102 having a hollow interior cavity 104. The body portion 102 includes a front wall 106, a rear wall 108, an interconnecting sidewall 110 and a bottom wall 112. The front and rear walls 106, 108 are spaced-apart from one another and interconnected by the sidewall 110 and the bottom wall 112. Together, the front wall 106, rear wall 108, sidewall 110 and bottom wall 112 cooperate to define an inwardly opening storage space 114. Specifically, the storage space 114 of the left-hand end module 100 opens inwardly in a second direction that is opposed to the first direction in which the storage space 84 of end module 70 opens. Thus, the storage space 114 of the left-hand end module 100 opens towards the right when mounted to the door 22, as shown in FIG. 2. The body portion 102 of the end module 100 further includes an inner surface 116 and an outer surface 118 that are spaced-apart from one another to define and surround the hollow interior cavity 104. Like the interior cavity 74 described above, the interior cavity 104 of the end module 100 is a generally U-shaped interior cavity. In use, the interior cavity 104 of the end module 100 is configured to receive an end portion of an intermediate module, as further described below. The sidewall 110 defines a closed end of the end module 100, while the hollow interior cavity 104 is disposed at an open end of the end module 100.

With specific reference to FIG. 9B, the end module 70 also includes an engagement member 90 disposed on the rear wall 108. The engagement member 90 of the end module 100 is the same as the engagement member 90 described above with end module 70, and is also configured to receive a mounting plate of a mounting member. In the first configuration of the storage compartment system 30 shown in FIG. 2, is contemplated that the end module 100 would be mounted to mounting member 36A (FIG. 4B).

Figure 10A:
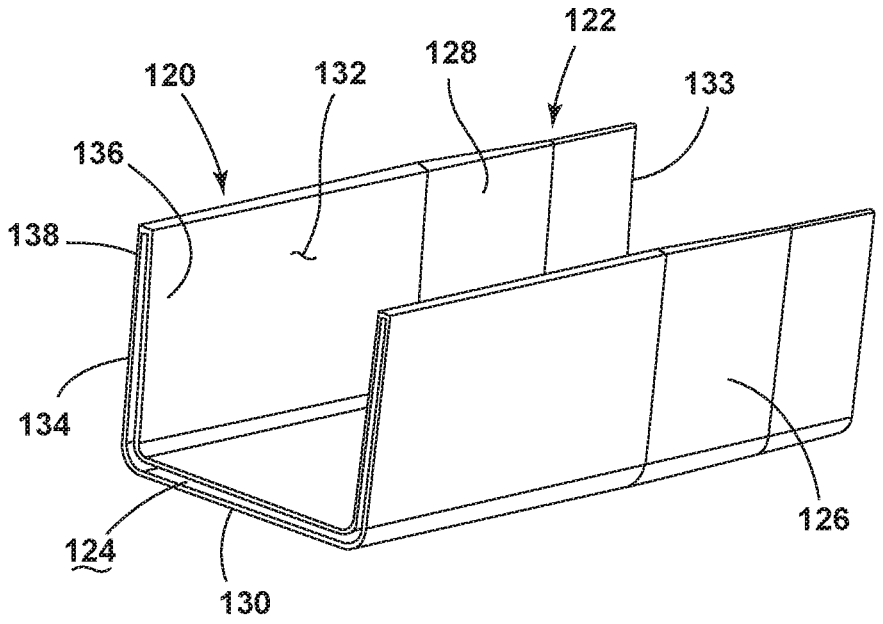
FIG. 10A is a top front perspective view of a storage compartment adapter module.
Figure 10B:
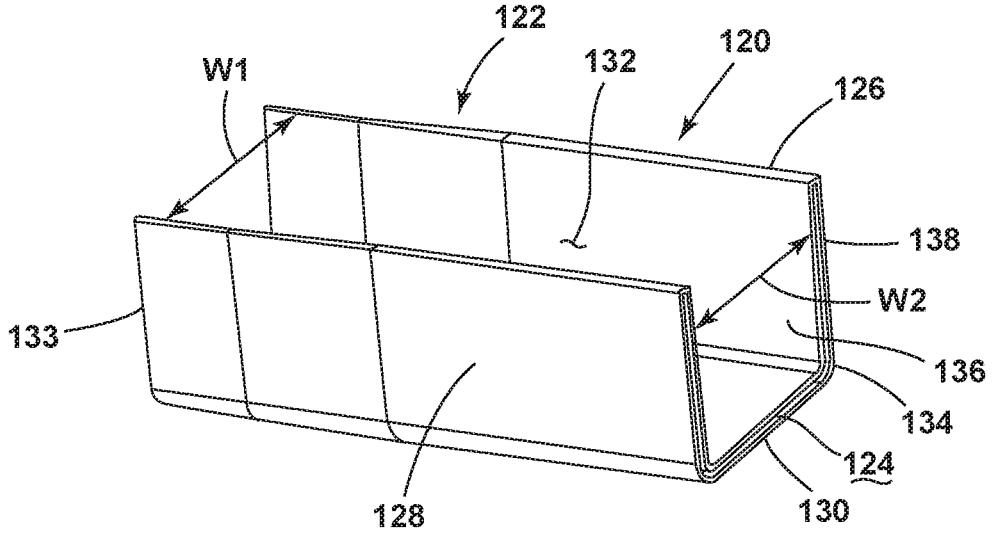
FIG. 10B is a top rear perspective view of the storage compartment adapter module of FIG. 10A.

Referring now to FIGS. 10A and 10B, a storage compartment adapter module 120 is shown. The adapter module 120 includes a body portion 122 having a hollow interior cavity 124. The body portion 122 includes a first wall 126, a second wall 128 and an interconnecting bottom wall 130. Together, the first wall 126, the second wall 128 and the bottom wall 130 cooperate to define an upwardly opening storage space 132. The body portion 122 of the adapter module 120 further includes an inner surface 136 and an outer surface 138 that are spaced-apart from one another to define and surround the hollow interior cavity 124. Like the interior cavities 74 and 104 described above, the interior cavity 124 of the adapter module 120 is a generally U-shaped interior cavity. In use, the interior cavity 124 of the adapter module 120 is configured to receive an end portion of an intermediate module, as further described below.

With specific reference to FIG. 10B, the adapter module 120 includes first and second ends 133, 134 which have varying widths W1, W2, respectively. It is contemplated that the width W2 of the second end 134 is wider than the width W1 of the first end 133, such that the adapter module 120 can provide different widths for various storage compartments. The interior cavity 124 of the adapter module 120 is disposed at the second end 134 of the adapter module 120 only. Thus, the first end 133 of the adapter module 120 is configured to be received within an interior cavity of an end module in assembly, such as interior cavities 74 and 104 described above with reference to end modules 70 and 100. As shown in FIG. 2, the adapter module 120 can be mounted in different directions as found in the configuration of storage compartment 32A. Thus, either the first wall 126 or the second wall 128 of the adapter module 120 can be positioned against the outer surface 28 of the door liner 24 of the door 22. Further, it is noted that the adapter module 120 shown in the embodiment of FIGS. 10A and 10B does not include an engagement member, but could include an engagement member if desired. Without an engagement member, the adapter module 120 couples to mounted storage compartment modules, such as end modules 70, 100 and intermediate module 140 described below, to support the adapter module 120 on the door 22.

Figure 11A:
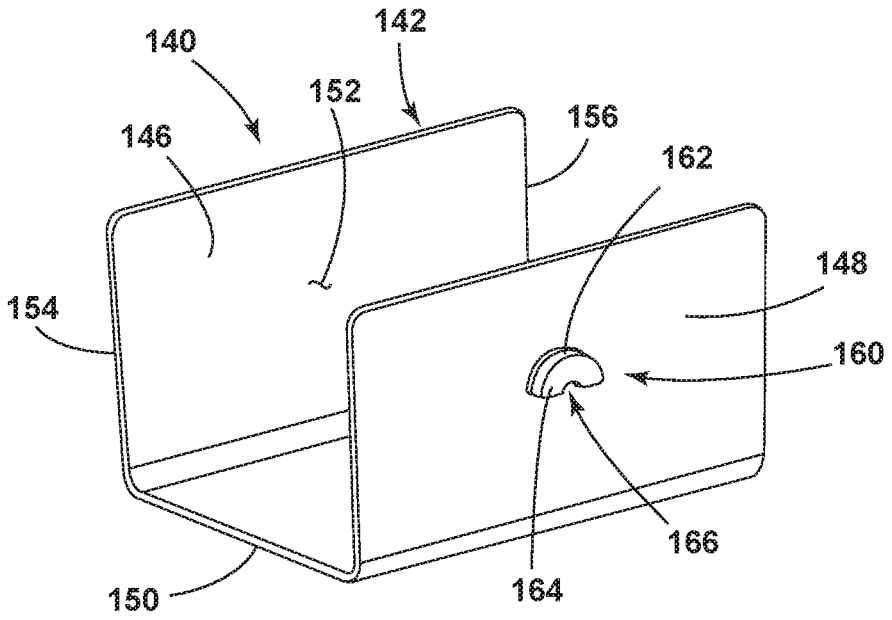
FIG. 11A is a top rear perspective view of a storage compartment intermediate module.
Figure 11B:
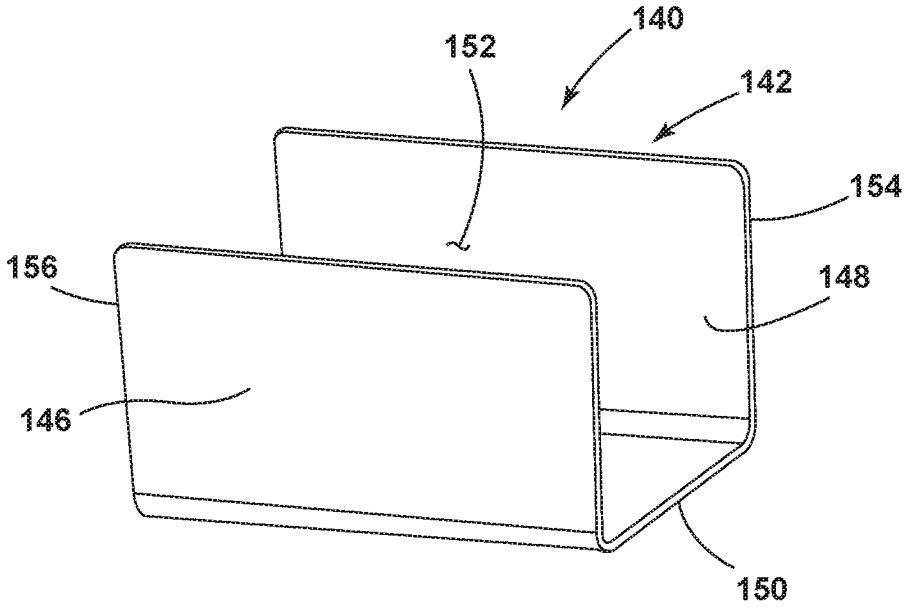
FIG. 11B is a top front perspective view of the storage compartment intermediate module of FIG. 11A.

Referring now to FIGS. 11A and 11B, a storage compartment intermediate module 140 is shown. The intermediate module 140 includes a body portion 142 having a front wall 146 that is spaced apart from a rear wall 148 and interconnected by a bottom wall 150 to define an overall U-shaped configuration of the body portion 142. Together, the front wall 146, the rear wall 148 and the bottom wall 150 cooperate to define an upwardly opening storage space 152. The body portion 142 of the intermediate module 140 is contemplated to be a solid body portion having first and second ends 154, 156. The first and second ends 154, 156 are U-shaped ends having U-shaped cross-sections that are configured to be received within the U-shaped interior cavities 74, 104 of the end modules 70, 100, respectively. Further, the first and second ends 154, 156 of the intermediate module 140 are also configured to be received within the U-shaped interior cavity 124 of the adapter module 120.

With specific reference to FIG. 11A, the intermediate module 140 includes an engagement member 160 disposed on the rear wall 148. The engagement member 160 includes a similar configuration to the engagement member 90 described above with reference to end modules 70, 100. Specifically, the engagement member 160 of the intermediate module 140 includes a first portion 162 that outwardly extends from the rear wall 148 of the intermediate module 140. The engagement member 160 further includes a second portion 164 that downwardly extends from the end of the first portion 162. Together the first and second portions 162, 164 of the engagement member 160 and the rear wall 148 of the intermediate module 140 cooperate to define a downwardly opening receiving channel 166. The downwardly opening receiving channel 166 of the intermediate module 140 is configured to receive a mounting plate of a mounting member, such as mounting plate 50 described above with reference to mounting member 36A, to removeably mount the intermediate module 140 to the door 22. Specifically, the downwardly opening receiving channel 166 is a downwardly curved receiving channel configured to closely receive the curved upper portion 60 of a corresponding mounting plate 50. In the first configuration of the storage compartment system 30 shown in FIG. 2, is contemplated that the intermediate module 140 would be mounted to mounting member 36C (FIG. 4B).

Figure 12:
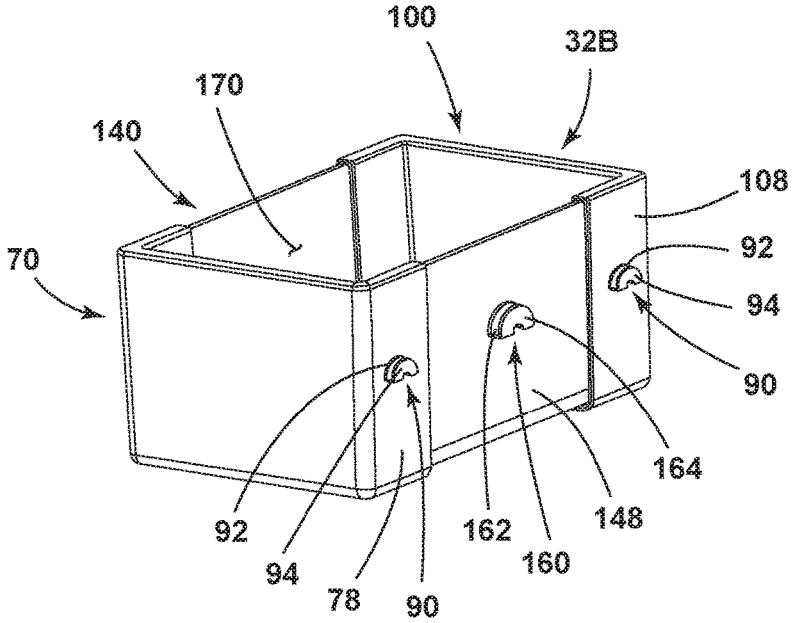
FIG. 12 is a top rear perspective view of a storage compartment.

While the engagement member 160 of the intermediate module 140 shares common features with the engagement member 90 of the end modules 70, 100, it is noted that the first portion 162 of the engagement member 160 extends outwardly to a greater extent from the rear wall 148 of the intermediate module 140 than the first portion 92 of the engagement member 90 extends outwardly from the rear walls 78, 108 of the end modules 70, 100. The relationship between the engagement members 160, 90 is best shown in FIG. 12. This greater outward extension of the engagement member 160 from the rear wall 148 of the intermediate module 140 allows for the engagement member 160 to couple to and associated mounting member when the first and second ends 154, 156 of the intermediate module 140 are received in interior cavities of associated storage compartment modules. This is because being received within the interior cavities of associated storage compartment modules spaces the intermediate module 140 away from the outer surface 28 of the door liner 24 of the door 22 as mounted thereto.

Referring now to FIG. 12, storage compartment 32B is shown as comprised of end module 70 and end module 100 which are interconnected by intermediate module 140. Together, the storage spaces 84, 114 and 152 of the end modules 70, 100 and intermediate module 140, respectively, cooperate to define a combined storage space 170. As further shown in FIG. 12, the storage compartment 32B includes engagement members 90 disposed on an outwardly extending from the rear walls 78 and 108 of the end modules 70, 100, respectively. Further, engagement member 160 is shown extending outwardly from the rear wall 148 of the intermediate module 140. As noted above, engagement member 160 extends outwardly from the rear wall 148 of the intermediate module 140 to a greater degree than the engagement members 90 extend outwardly from the rear walls 78 and 108 of the end modules 70, 100, respectively. This is provided by a greater extension of the first portion 162 of the engagement member 160 as compared to the extension of the first portion 92 of the engagement members 90. In this way, it is contemplated that the second portions 94 and 164 of the respective engagement members 90, 160 will be provided at a consistent distance from the storage compartment 32B for engagement of an assembled storage compartment with the respective engagement members. In the embodiment of FIG. 12, is contemplated that the first and second ends 154, 156 of the intermediate module 140 are slideably and removeably received in the respective interior cavities 74, 104 of the end modules 70, 100 to form the storage compartment 32B.

Figure 13:
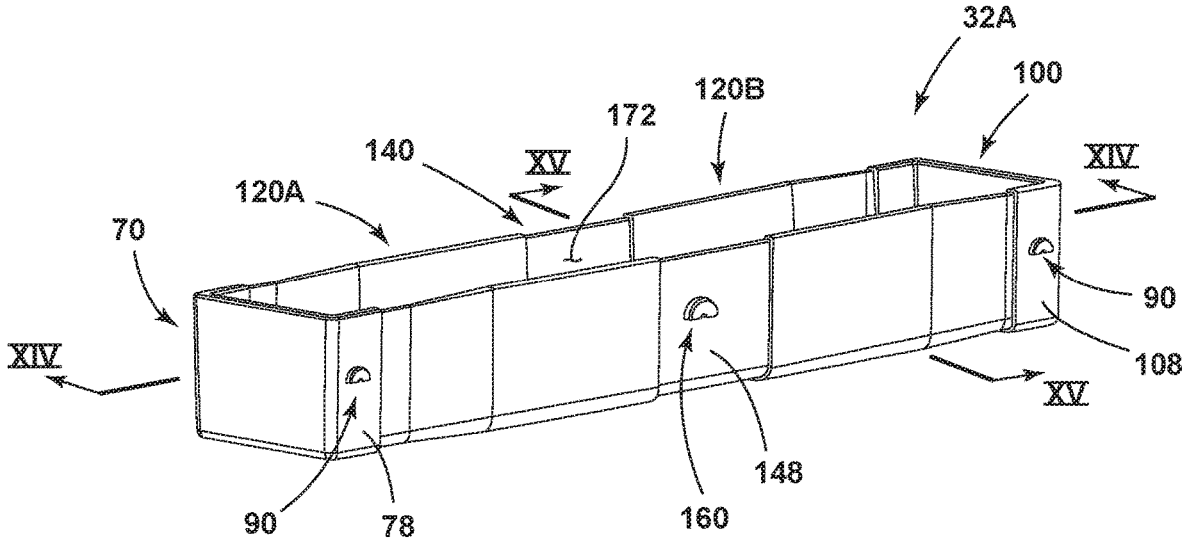
FIG. 13 is a top rear perspective view of a storage compartment.

Referring now to FIG. 13, storage compartment 32A is shown as comprised of end modules 70, 100, which are each connected with a respective adapter module 120A, 120B. The adapter module 120A, 120B are configured in the same manner as adapter module 120 described above, but are specifically identified as adapter modules 120A, 120B to denote the different directions in which the adapter modules 120A, 120B are positioned. The adapter modules 120A, 120B are interconnected by an intermediate module 140. Together, the storage spaces 84, 114, 132(×2) and 152 of the end modules 70, 100, adapter modules 120A, 120B and intermediate module 140, respectively, cooperate to define a combined storage space 172. As further shown in FIG. 13, the storage compartment 32A includes engagement members 90 disposed on and outwardly extending from the rear walls 78 and 108 of the end modules 70, 100, respectively. Further, engagement member 160 is shown extending outwardly from the rear wall 148 of the intermediate module 140. Again, the respective engagement members 90, 160 are used to removeably mount the storage compartment 32A to associated mounting members in any number of configurations along the door 22.

Figure 14:
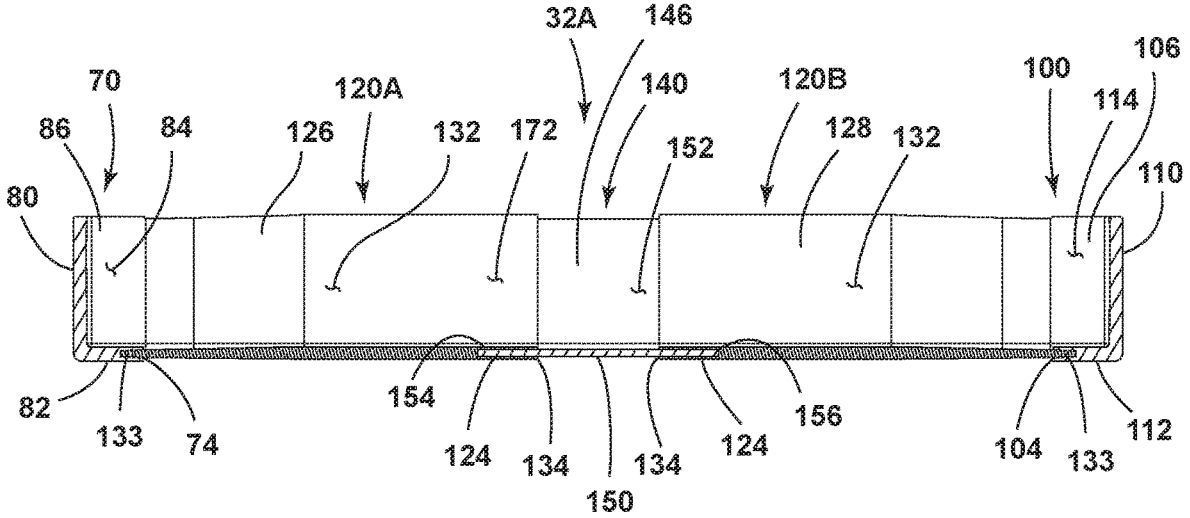
FIG. 14 is a cross-sectional side elevation view of the storage compartment of FIG. 13 taken at line XIV.

Referring now to FIG. 14, storage compartment 32A is shown in a cross-sectional view, wherein the end modules 70, 100, the adapter modules 120A, 120B, and the intermediate module 140 are all shown interconnected with one another. The storage spaces 84, 114, 132(×2) and 152 of the end modules 70, 100, adapter modules 120A, 120B and intermediate module 140, respectively, cooperate to define the combined storage space 172 of the storage compartment 32A. As illustrated in FIG. 14, the first end 133 of the adapter module 120A is shown as being received in the hollow interior cavity 74 of the end module 70. The second end 134 of the adapter module 120A includes the hollow interior cavity 124 in which the first end 154 of the intermediate module 140 is received. The second end 156 of the intermediate module 140 is received in the hollow interior cavity 124 of the adapter module 120B at the second end 134 thereof. As further illustrated in FIG. 14, the first end 133 of the adapter module 120B is shown as being received in the hollow interior cavity 104 of the end module 100. In this way, the individual modules of the storage compartment 32A are interconnected with one another. Further, it is contemplated that the individual modules of the storage compartment 32A are releasably coupled with one another such that end portions of the different modules are contemplated to be slidably received in the respective hollow interior cavities of adjacent modules. In this way, the individual modules can be removed and reconfigured to form other storage compartment configurations.

Figure 15:
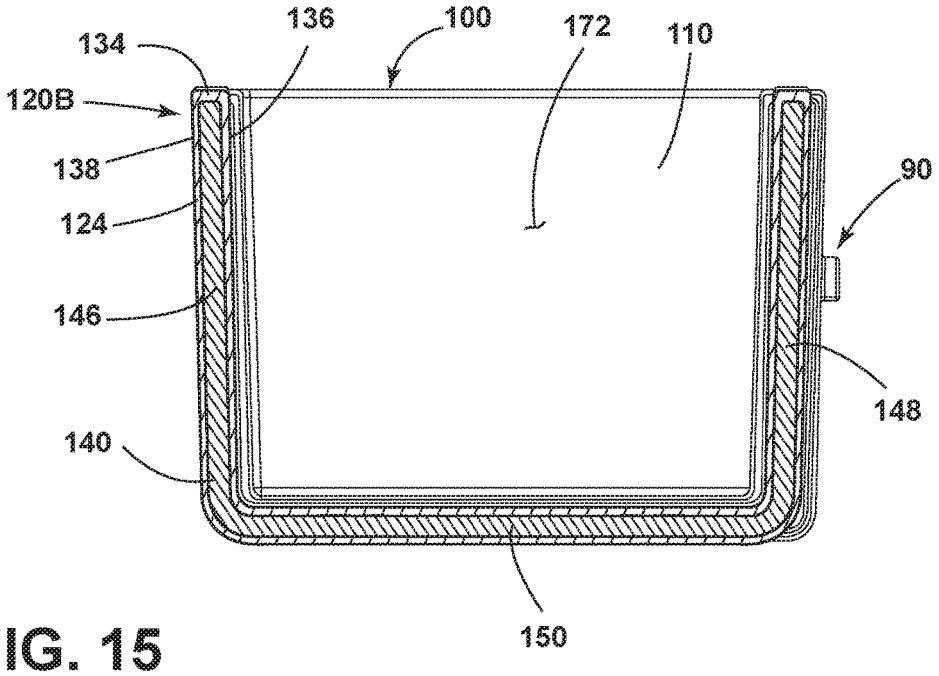
FIG. 15 is a cross-sectional side elevation view of the storage compartment of FIG. 13 taken at line XV.

Referring now to FIG. 15, intermediate module 140 is shown having front and rear walls 146, 148 and bottom wall 150 received within the hollow interior cavity 124 of the adapter module 120B at the second end 134 of the adapter module 120B. As noted above, the hollow interior cavity 124 of the adapter module 120B is defined between the inner and outer surfaces 136, 138 of the adapter module 120B. Thus, the U-shaped cross-section of the intermediate module 140 is shown as being received within the U-shaped hollow interior cavity 124 of the adapter module 120B.

Figure 16:
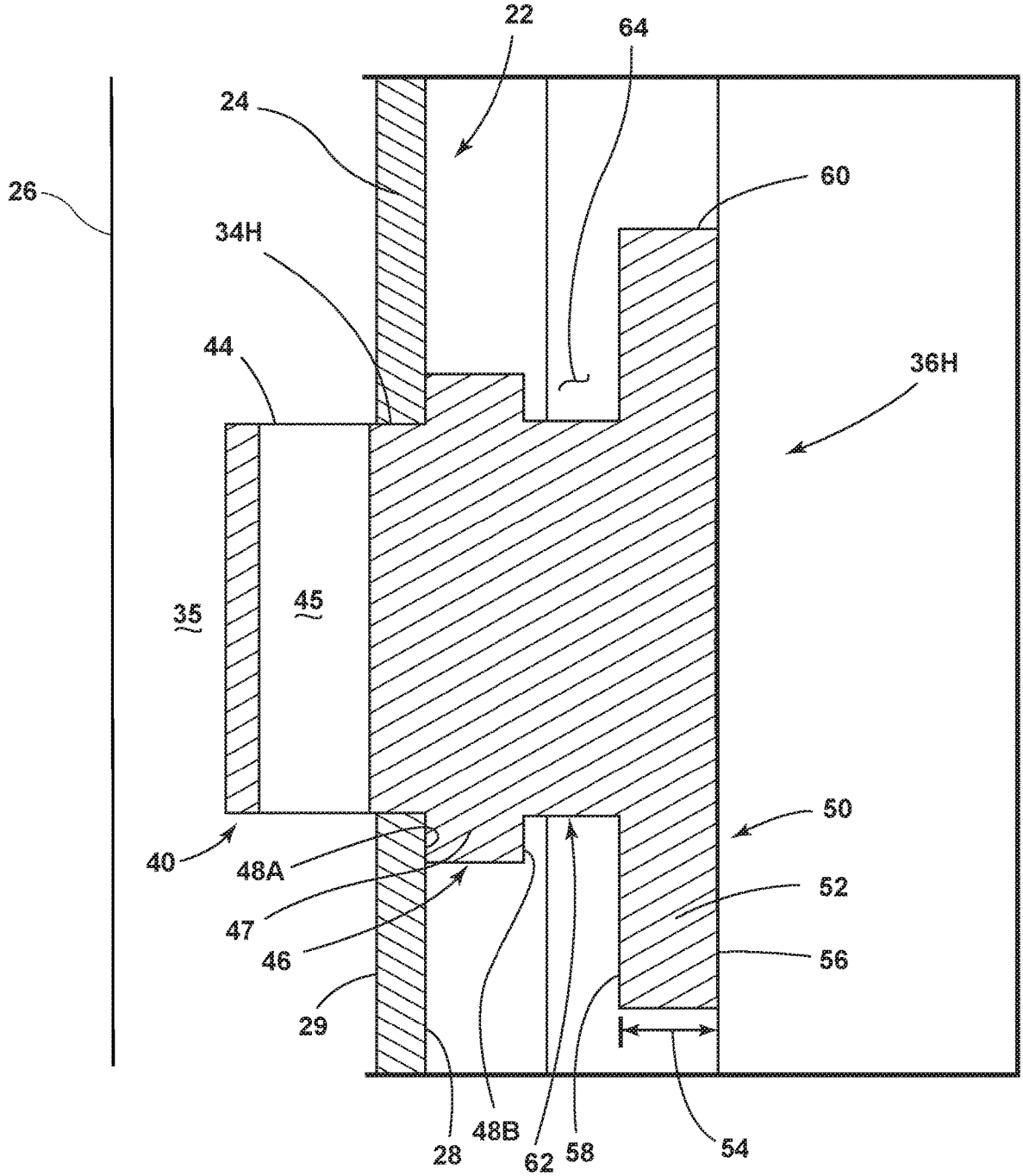
FIG. 16 is a cross-sectional view of the door of FIG. 6 taken at location XVI.

Referring now to FIG. 16, mounting member 36H is shown as mounted to mounting aperture 34H of the door liner 24. As mounted thereto, the base portion 40 of the mounting member 36H is shown extending past the door liner 24 into the inner cavity 35 of the door 22. Thus, the hollow interior portion 45 of the base portion 40 of the mounting member 36H is configured to receive a foam insulation material within the inner cavity 35 of the door 22. The rear surface 48A of the abutment plate 46 is shown abutting the outer surface 28 of the door liner 24. The upwardly opening channel 64 of the mounting member 36H is shown disposed between front surface 48B of the abutment plate 46 and the inner surface 58 of the mounting plate 50. The description of mounting member 36H as shown in FIG. 16 corresponds to any mounting member of the present concept that is unused or available along the door 22, including mounting member 36M described below with reference to FIG. 17.

Figure 17:
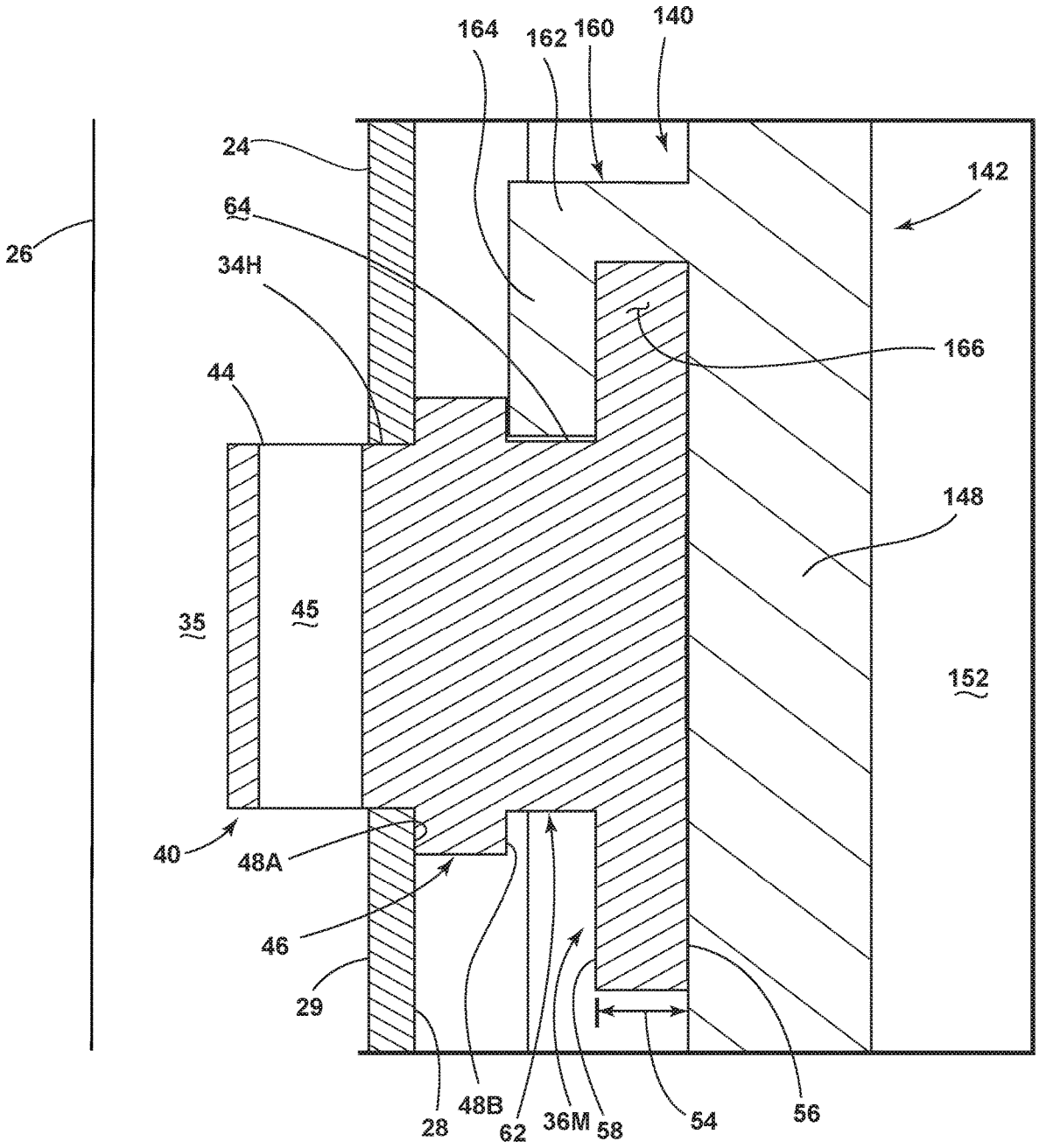
FIG. 17 is a cross-sectional view of the door of FIG. 6 taken at location XVII.

Referring now to FIG. 17, intermediate module 140 is shown having engagement member 160 mounted to mounting plate 50 of mounting member 36M. In FIG. 17, the rounded or curved upper portion 60 of the mounting plate 50 is shown received within the downwardly opening receiving channel 166 defined by the first and second portions 162, 164 of the engagement member 160. As noted above, the stem 62 of the mounting member 36M spaces the mounting plate 50 away from the abutment plate 46 to define an upwardly opening channel 64 positioned between the abutment plate 46 and the mounting plate 50. The second portion 164 of the engagement member 160 is received in the upwardly opening channel 64 of the mounting member 36M when loaded thereon. It is contemplated that the engagement member 160 of the intermediate module 140 is vertically loaded in a downward direction on the mounting plate 50 of the mounting member 36M during installation. As such, the intermediate module 140 shown in FIG. 17 is securely mounted to the mounting member 36M, but may also be removed by vertically lifting the intermediate module 140 in an upward direction.

According to one aspect of the present disclosure, a refrigerator includes a housing defining an interior compartment with an open side. A door is rotatably coupled to the housing and selectively closes at least a portion of the open side. The door includes a door liner having an outer surface. At least one mounting member is coupled to the door liner and includes a mounting plate extending outwardly from the outer surface of the door liner. A first storage compartment includes at least one module. The one module includes a rear wall and an engagement member extending outwardly from the rear wall. The engagement member includes a downwardly opening receiving channel. The mounting plate of the mounting member is received in the downwardly opening receiving channel of the engagement member to removeably mount the first storage compartment to the door liner of the door.

According to another aspect of the present disclosure, the mounting plate includes a curved upper portion.

According to another aspect of the present disclosure, the downwardly opening receiving channel is downwardly curved and configured to receive the curved upper portion of the mounting plate.

According to another aspect of the present disclosure, the door includes a wrapper spaced-apart from the door liner to define an inner cavity of the door therebetween.

According to another aspect of the present disclosure, the door liner includes a mounting aperture opening into the inner cavity of the door and through which a base portion of the mounting member is received.

According to another aspect of the present disclosure, the base portion of the mounting member includes a hollow interior portion disposed within the inner cavity of the door.

According to another aspect of the present disclosure, the refrigerator includes an insulation material disposed within the inner cavity of the door, wherein a portion of the insulation material at least partially fills the hollow interior portion of the mounting member.

According to another aspect of the present disclosure, a storage compartment system includes a first end module having a body portion with inner and outer surfaces spaced-apart from one another to define a hollow interior cavity therebetween. The body portion of the first end module defines a storage space inwardly opening in a first direction. A second end module includes a body portion with inner and outer surfaces spaced-apart from one another to define a hollow interior cavity therebetween. The body portion of the second end module defines a storage space inwardly opening in a second direction that is opposed to the first direction. An intermediate module includes a body portion with a U-shaped configuration to define an upwardly opening storage space. The body portion of the intermediate module includes first and second ends. The first end of the body portion of the intermediate module is received in the hollow interior cavity of the first end module. The second end of the body portion of the intermediate module is received in the hollow interior cavity of the second end module.

According to another aspect of the present disclosure, the intermediate module includes an engagement member having a first portion extending outwardly from a rear wall of the body portion of the intermediate module, and further wherein the engagement member of the intermediate module includes a second portion downwardly extending from the first portion to define a downwardly opening receiving channel.

According to another aspect of the present disclosure, the downwardly opening receiving channel of the engagement member of the intermediate module is downwardly curved.

According to another aspect of the present disclosure, the first end module includes an engagement member having a first portion extending outwardly from a rear wall of the body portion of the first end module, and further wherein the engagement member of the first end module includes a second portion downwardly extending from the first portion to define a downwardly opening receiving channel.

According to another aspect of the present disclosure, the downwardly opening receiving channel of the engagement member of the first end module is downwardly curved.

According to another aspect of the present disclosure, the second end module includes an engagement member having a first portion extending outwardly from a rear wall of the body portion of the second end module, and further wherein the engagement member of the second end module includes a second portion downwardly extending from the first portion to define a downwardly opening receiving channel.

According to another aspect of the present disclosure, the first and second ends of the intermediate module are slideably received in the respective hollow interior cavities of the first and second end modules.

According to yet another aspect of the present disclosure, a refrigerator includes a door having a door liner. The door liner includes a plurality of mounting apertures disposed therethrough and opening into an inner cavity of the door. A plurality of mounting members is provided, wherein each mounting member of the plurality of mounting members includes a base portion having a hollow interior portion. Each base portion of each mounting member is received through one of the mounting apertures of the plurality of mounting apertures of the door liner and is at least partially received within the inner cavity of the door. An insulation material is disposed within the inner cavity of the door and at least partially fills each hollow interior portion of each base portion of the plurality of mounting members.

According to another aspect of the present disclosure, the plurality of mounting apertures includes square-shaped mounting apertures.

According to another aspect of the present disclosure, each base portion of each mounting member of the plurality of mounting members includes a square-shaped body portion.

According to another aspect of the present disclosure, each mounting member of the plurality of mounting members includes an abutment plate having front and rear surfaces, wherein the rear surface of each abutment plate abuts an outer surface of the door liner.

According to another aspect of the present disclosure, each mounting member of the plurality of mounting members includes a mounting plate extending outwardly from the front surface of the abutment plate.

According to another aspect of the present disclosure, each mounting plate of each mounting member of the plurality of mounting members includes a downwardly curved upper portion.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator, comprising:

a housing defining an interior compartment with an open side;

a door rotatably coupled with the housing and selectively closing at least a portion of the open side, the door including a door liner having an outer surface;

a plurality of mounting members coupled to the door liner, each said mounting member having a mounting plate extending outwardly from the outer surface of the door liner; and a storage compartment comprising:

a first end module having a body portion with a hollow interior cavity and a rear wall with an engagement member extending outwardly from the rear wall, wherein the engagement member includes a downwardly opening receiving channel configured to receive the mounting plate of one of the mounting members of the plurality of mounting members to removeably mount the first end module to the door liner of the door;

a first adapter module having a body portion with first and second ends, wherein the first end of the first adapter module is received in the hollow interior cavity of the first end module and includes a first width, and further wherein the second end of the first adapter module includes a hollow interior cavity and a second width that is greater than the first width of the first end of the first adapter module;

a second end module having a body portion with a hollow interior cavity and a rear wall with an engagement member extending outwardly from the rear wall, wherein the engagement member of the second end module includes a downwardly opening receiving channel configured to receive the mounting plate of one of the mounting members of the plurality of mounting members to removeably mount the second end module to the door liner of the door;

a second adapter module having a body portion with first and second ends, wherein the first end of the second adapter module is received in the hollow interior cavity of the second end module and includes a first width, and further wherein the second end of the second adapter module includes a hollow interior cavity and a second width that is greater than the first width of the first end of the second adapter module; and an intermediate module having a body portion with first and second ends and a rear wall with an engagement member extending outwardly from the rear wall, wherein the engagement member of the intermediate module includes a downwardly opening receiving channel configured to receive the mounting plate of one of the mounting members of the plurality of mounting members to removeably mount the intermediate module to the door liner of the door, and further wherein the first end of the body portion of the intermediate module is received in the hollow interior cavity of the first adapter module, and further wherein the second end of the body portion of the intermediate module is received in the hollow interior cavity of the second adapter module.

2. The refrigerator of claim 1, wherein each said mounting plate includes a curved upper portion.

3. The refrigerator of claim 2, wherein each said downwardly opening receiving channel is downwardly curved and configured to receive the curved upper portion of each said mounting plate.

4. The refrigerator of claim 1, wherein the door includes a wrapper spaced-apart from the door liner to define an inner cavity of the door therebetween.

5. The refrigerator of claim 4, wherein the door liner includes a plurality of mounting apertures opening into the inner cavity of the door and through which a base portion of each said mounting member of the plurality of mounting members is received.

6. The refrigerator of claim 5, wherein the base portion of each said mounting member of the plurality of mounting members includes a hollow interior portion disposed within the inner cavity of the door.

7. The refrigerator of claim 6, including:

an insulation material disposed within the inner cavity of the door, wherein a portion of the insulation material at least partially fills the hollow interior portion of each said mounting member of the plurality of mounting members.

8. The refrigerator of claim 5, wherein the plurality of mounting apertures includes square-shaped mounting apertures.

9. The refrigerator of claim 8, wherein each said base portion of each said mounting member of the plurality of mounting members includes a square-shaped body portion.

10. The refrigerator of claim 9, wherein each said mounting member of the plurality of mounting members includes an abutment plate having front and rear surfaces, wherein the rear surface of each said abutment plate abuts an outer surface of the door liner.

11. A storage compartment system, comprising:

a first end module having a body portion with inner and outer surfaces spaced-apart from one another to define a hollow interior cavity therebetween, wherein the body portion of the first end module defines a storage space inwardly opening in a first direction;

a first adapter module having a body portion with first and second ends, wherein the first end of the first adapter module is received in the hollow interior cavity of the first end module, and further wherein the second end of the first adapter module includes inner and outer surfaces spaced-apart from one another to define a U-shaped hollow interior cavity therebetween;

a second end module having a body portion with inner and outer surfaces spaced-apart from one another to define a hollow interior cavity therebetween, wherein the body portion of the second end module defines a storage space inwardly opening in a second direction that is opposed to the first direction;

a second adapter module having a body portion with first and second ends, wherein the first end of the second adapter module is received in the hollow interior cavity of the second end module, and further wherein the second end of the second adapter module includes inner and outer surfaces spaced-apart from one another to define a U-shaped hollow interior cavity therebetween; and an intermediate module having a body portion with a U-shaped configuration to define an upwardly opening storage space, wherein the body portion of the intermediate module includes first and second ends, and further wherein the first end of the body portion of the intermediate module is received in the U-shaped hollow interior cavity of the first adapter module, and further wherein the second end of the body portion of the intermediate module is received in the U-shaped hollow interior cavity of the second adapter module.

12. The storage compartment system of claim 11, wherein the intermediate module includes an engagement member having a first portion extending outwardly from a rear wall of the body portion of the intermediate module, and further wherein the engagement member of the intermediate module includes a second portion downwardly extending from the first portion to define a downwardly opening receiving channel.

13. The storage compartment system of claim 12, wherein the downwardly opening receiving channel of the engagement member of the intermediate module is downwardly curved.

14. The storage compartment system of claim 12, wherein the first end module includes an engagement member having a first portion extending outwardly from a rear wall of the body portion of the first end module, and further wherein the engagement member of the first end module includes a second portion downwardly extending from the first portion to define a downwardly opening receiving channel.

15. The storage compartment system of claim 14, wherein the downwardly opening receiving channel of the engagement member of the first end module is downwardly curved.

16. The storage compartment system of claim 14, wherein the second end module includes an engagement member having a first portion extending outwardly from a rear wall of the body portion of the second end module, and further wherein the engagement member of the second end module includes a second portion downwardly extending from the first portion to define a downwardly opening receiving channel.

17. The storage compartment system of claim 11, wherein the first and second ends of the intermediate module are slideably received in the respective hollow interior cavities of the first and second end modules.

* * * * *